United States Patent [19]

Lin et al.

[11] Patent Number: 4,584,253

[45] **Date of Patent: * Apr. 22, 1986**

[54] ELECTROPHOTOGRAPHIC IMAGING SYSTEM

[75] Inventors: John W. Lin; Lesley P. Dudek, both of Webster, N.Y.

[73] Assignee: Xerox Corporation, Stamford, Conn.

[ * ] Notice: The portion of the term of this patent subsequent to Jan. 7, 2003 has been disclaimed.

[21] Appl. No.: 686,046

[22] Filed: Dec. 24, 1984

[51] Int. Cl.[4] ..... G03G 5/14; G03G 5/04

[52] U.S. Cl. ..... 430/59; 430/60; 430/64; 430/66; 430/67

[58] Field of Search ..... 430/59, 60, 64, 66, 430/67

[56] References Cited

U.S. PATENT DOCUMENTS

| | | | |
|---|---|---|---|
| 3,617,271 | 11/1971 | Poot et al. | 96/1.5 |
| 3,652,269 | 3/1972 | Contois et al. | 96/1.5 |
| 3,682,632 | 8/1972 | Arai et al. | 430/60 |
| 3,729,312 | 4/1973 | Young, Jr. | 96/1.5 |
| 3,864,126 | 2/1975 | Nishide | 96/1.5 |
| 3,951,654 | 4/1976 | Mammino | 96/1.6 |
| 3,961,954 | 6/1976 | Pfister et al. | 96/1.6 |
| 3,966,468 | 6/1976 | Contois et al. | 96/1.5 |
| 4,063,947 | 12/1977 | Pochan et al. | 96/1.5 N |
| 4,081,274 | 3/1978 | Horgan | 96/1 PC |
| 4,082,550 | 4/1978 | Yoerger | 96/1.5 R |
| 4,152,152 | 5/1979 | Contois et al. | 96/1.6 |
| 4,184,871 | 1/1980 | Oba et al. | 430/90 |
| 4,232,103 | 11/1980 | Limburg et al. | 430/59 |
| 4,245,021 | 1/1981 | Kazami et al. | 430/58 |
| 4,256,821 | 3/1981 | Enomoto | 430/59 |
| 4,265,990 | 5/1981 | Stolka et al. | 430/59 |
| 4,291,110 | 9/1981 | Lee | 430/59 |
| 4,293,630 | 10/1981 | Oka | 430/59 |
| 4,341,852 | 7/1982 | Mattes et al. | 430/83 |
| 4,365,014 | 12/1982 | Sakai et al. | 430/59 |
| 4,388,392 | 6/1983 | Kato et al. | 430/58 |
| 4,396,695 | 8/1983 | Dimmler et al. | 430/59 |
| 4,397,931 | 8/1983 | Limburg et al. | 430/59 |
| 4,419,429 | 12/1983 | Nakazawa | 430/83 |
| 4,454,212 | 6/1984 | Sekai et al. | 430/59 |
| 4,464,450 | 8/1984 | Teuscher | 430/59 |

FOREIGN PATENT DOCUMENTS

| | | | |
|---|---|---|---|
| 54-6547 | 1/1979 | Japan | 430/66 |
| 54-065671 | 5/1979 | Japan . | |
| 55-98756 | 7/1980 | Japan | 430/66 |
| 56-25749 | 3/1981 | Japan | 430/67 |
| 58-37649 | 3/1983 | Japan | 430/60 |
| 992596 | 5/1965 | United Kingdom | 430/64 |
| 2059617 | 4/1981 | United Kingdom . | |

*Primary Examiner*—Roland E. Martin

*Attorney, Agent, or Firm*—Peter H. Kondo

[57] ABSTRACT

An electrophotographic imaging member is disclosed comprising a charge generation layer, a contiguous charge transport layer comprising an aromatic amine or hydrazone charge transport molecule in a continuous polymeric binder phase, and a cellulosic hole trapping material located on the same side of the charge transport layer as the charge generation layer, the cellulosic hole trapping material being free of electron withdrawing groups and having the structural formula

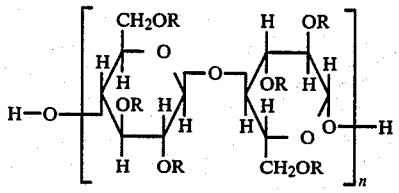

wherein R is independently selected from the group consisting of hydrogen and a substituted or unsubstituted group selected from the group consisting of an alkyl group containing 1 to 20 carbon atoms, a hydroxyalkyl group containing 1 to 20 carbon atoms, a hydroxyether group containing 1 to 20 carbon atoms and an aminoalkyl group containing 1 to 20 carbon atoms, and n is the number of cellulose repeating units from 1 to 3,000. A process for using this electrophotographic imaging member is also disclosed.

16 Claims, No Drawings

ELECTROPHOTOGRAPHIC IMAGING SYSTEM

BACKGROUND OF THE INVENTION

This invention relates in general to electrophotography and, more specifically, to a novel electrophotographic imaging member and process for using the imaging member.

In the art of electrophotography, an electrophotographic imaging member containing a photoconductive layer is imaged by first uniformly electrostatically charging the imaging surface of the imaging member. The member is then exposed to a pattern of activating electromagnetic radiation such as light which selectively dissipates the charge in the illuminated areas of the photoconductive layer while leaving behind an electrostatic latent image in the non-illuminated areas. This electrostatic latent image may then be developed to form a visible image by depositing finely divided properly charged toner particles on the surface of the photoconductive layer to form a toner image which is thereafter transferred to a receiving member and fixed thereto.

A photoconductive layer for use in xerography may be a homogeneous layer of a single material such as vitreous selenium or it may be a composite of layers containing a photoconductor and another material. One type of composite photoconductive photoreceptor used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Such a photoconductive layer is often referred to as a charge generating or photogenerating layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may function as a cathode when the charge transport layer is sandwiched between the electrode and a photoconductive layer which is capable of photogenerating holes and electrons and injecting the photogenerated holes into the charge transport layer. The transport layer in this embodiment must, of course, be capable of supporting the injection of the photogenerated holes from the photoconductive layer and transporting the holes through the transport layer to the conductive substrate when the outer surface of the photoconductive layer is charged with uniform charges of a positive polarity.

Other types of composite photoconductor employed in xerography include photoresponsive devices in which a conductive substrate or electrode is coated with optional blocking and/or adhesive layers, a charge transport layer such as a hole transport layer, and a photoconductive layer. Where the transport layer is a hole transport layer, the outer surface of the photoconductive layer is charged positively. These types of composite photoconductors are described, for example, in copending applications U.S. Ser. No. 613,137, filed on May 23, 1984, entitled "Silylated Compositions and Deuterated Hydroxyl Squaraine Compositions and Processes" and U.S. Ser. No. 487,953, filed on Apr. 25, 1983, entitled "Overcoated Photoresponsive Devices", the entire disclosures thereof being incorporated herein in their entirety.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain hole transporting aromatic amine compounds. Various charge generating layers comprising photoconductive layers exhibiting the capability of photogeneration of holes and injection of the holes into a charge transport layer have also been investigated. Typical inorganic photoconductive materials utilized in the charge generating layer include amorphous selenium, amorphous silicon, trigonal selenium, and selenium alloys such as selenium-tellurium, selenium-tellurium-arsenic, selenium-arsenic, and the like. The organic photoconductive materials utilized in the charge generating layer include metal free phthalocyanines, metal phthalocyanines such as vanadyl phthalocyanines, substituted and unsubstituted squaraine compounds, thiopyrylium compounds and azo dyes, diazo dyes, pyrilium derivatives, and the like. The charge generation layer may comprise a homogeneous photoconductive material or particulate photoconductive material dispersed in a binder. Some examples of homogeneous and particulate photoconductive materials with or without a polymeric binder in a charge generation layer are disclosed in U.S. Pat. No. 4,265,990, the disclosure of this patent being incorporated herein in its entirety.

Electrophotographic imaging members comprising a charge transport layer sandwiched between a photogenerating layer containing a vanadyl phthalocyanine pigment and a conductive substrate normally exhibit very good electrical properties. However, it has been found that when the photogenerating layer is formed by conventional solution coating techniques such as by means of a Bird (draw bar) or a dip coating device, the resulting photoreceptor often exhibits very poor electrical properties such as poor charge acceptance, premature charge injection and high dark decay rates. Dark decay is defined as the loss of charge on a photoreceptor in the dark after uniform charging. This is an undesirable fatigue-like problem resulting in lower initial charges that cannot be maintained during image cycling and is unacceptable for automatic electrophotographic copiers, duplicators and printers which require precise, stable, and a predictable photoreceptor operating range. In relatively adverse situations, the charging capability of the photoreceptor gradually decreases upon cycling (cycle-down) and the photoreceptor becomes unsuitable for copying and printing. In more favorable situations, the photoreceptor may experience low charge acceptance rates in the first few imaging cycles. The charge acceptance level gradually increases (cycle-up) upon cycling and eventually reaches an almost constant value. The poor initial charge acceptance of a photoreceptor causes poor image quality, light density, poor solid area density or image deletion in the first few xerographic copies. This problem becomes more serious if the photoreceptor has been used for some time and dark-rested for several hours (e.g. overnight). For example, the charge acceptance level after dark-resting for photoreceptors containing vanadyl phthalocyanine in the photoconductive layer (often referred to as a photogenerating or generator layer) is usually lower than it normally would be under conditions where it has not dark-rested for several hours. This problem causes poor image quality in printed copies. This condition is partially due to the premature injection of charges into the hole transport layer either from the surface of the photoreceptor or from the charge generation layer under the influence of an electric field. If machine adjustments to compensate for these changing properties are made, copies made layer during cycling exhibit high background. This difference in performance may be due to process variations and different impurities levels in the photogeneration layer. Since the use of conventional coating technology to prepare photoreceptors of these types is partially desirable for large flexible electrophotographic imaging members, there is a need to overcome these poor electrical properties associated with solution coating of the photoreceptor layers.

Moreover, when the supporting conductive layer in photosensitive members comprising at least two electrically operative layers has a metal oxide, difficulties have been encountered with these photosensitive members under extended electrostatic cycling conditions found in high volume high speed copiers, duplicators and printers. For example, when certain charge generation layers comprising a resin and particulate photoconductor material are adjacent to an aluminum oxide layer, the phenomenon of cycling up is encountered. Cycling up is the build up of residual potential through repeated electrophotographic cycling. Build-up of residual potential can gradually increase under extended cycling. Residual potential causes the surface potential to increase accordingly. Build-up of residual potential and surface voltage causes ghosting, increased background on final copies and cannot be tolerated in high speed, high-volume copiers, duplicators and printers. It has also been found that some photoreceptors comprising at least two electrically operative layers exhibit cycling down of the surface voltage when exposed extended cycling. During cycling-down, the surface voltage and surface charge decrease as dark decay increases in the areas exposed and the contrast potential for good images degrade and causes faded images. These problems have been addressed by the use of a siloxane film as described in U.S. Pat. No. 4,464,450. Although excellent results have been achieved with this siloxane film, "white spots" deficient of toner material are occasionally observed in image areas of final copies.

Thus, the characteristics of photosensitive members comprising a conductive layer and at least two electrically operative layers, one of which is a charge transport layer comprising a film forming resin and one or more aromatic amine compounds and hydrazones, can exhibit deficiencies which are undesirable in modern copiers, duplicators, and printers. Accordingly, there is a need for compositions and processes which impart greater stability to electrophotographic imaging systems which undergo periodic cycling.

SUMMARY OF THE INVENTION

It is an object of the invention to provide an electrophotographic imaging member comprising a charge generation layer, a contiguous charge transport layer comprising an aromatic amine or hydrazone charge transport molecule in a continuous polymeric binder phase, and a cellulosic hole trapping material located on the same side of the charge transport layer as the charge generation layer, the cellulosic hole trapping material being free of electron withdrawing groups and having the structural formula

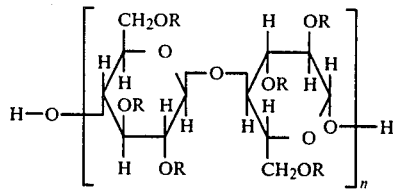

wherein R is independently selected from the group consisting of hydrogen and a substituted or unsubstituted group selected from the group consisting of an alkyl group containing 1 to 20 carbon atoms, a hydroxyalkyl group containing 1 to 20 carbon atoms, an hydroxyether group containing 1 to 20 carbon atoms and an aminoalkyl group containing 1 to 20 carbon atoms, and n is the number of cellulose repeating units from 1 to 3,000. A preferred cellulosic hole trapping material is one selected from the group consisting of a hydroxyalkylcellulose compound and derivatives thereof having a degree of substitution of up to 3 molar substitutions of the hydroxyl group of the cellulose per monosaccharide unit and having a weight average molecular weight between about 700 and about 2,000,000. This electrophotographic imaging member may be employed to form images in an electrophotographic imaging process.

Generally, an electrophotographic imaging member containing a cellulosic hole trapping compound of this invention comprises two electrically operative layers and a cellulosic hole trapping material on a supporting substrate. An electrophotoconductive member containing a cellulosic hole trapping compound of this invention comprises two electrically operative layers and a supporting substrate. This composite type electrophotoconductive member includes photoresponsive devices in which a conductive substrate or electrode is coated in sequence with optional blocking and/or adhesive layers, a charge transport layer such as a hole transport layer, a photoconductive layer, and an optional overcoating layer. Another type of composite electrophotoconductive member includes photoresponsive devices in which a conductive substrate or electrode is coated in sequence with optional blocking and/or adhesive layers, a photoconductive layer, a charge transport layer, and an optional overcoating layer.

In one embodiment, the layered photoresponsive device may comprise in the following sequence an electrically conductive substrate, an optional blocking layer, an optional adhesive layer, a photogenerating layer, a charge transport layer, and an optional overcoating layer. In another embodiment, the photoresponsive device comprises in the following sequence an electrically conductive substrate, an optional blocking layer, an optional adhesive layer, a transport layer, a charge generating layer, and an optional overcoating layer. In still another embodiment, photoresponsive devices useful in imaging systems may comprise in the following sequence an electrically conductive substrate, an optional blocking layer, an optional adhesive layer, a charge generating layer, another charge generating layer, a charge transport layer, and an optional overcoating layer. Depending on the specific configuration selected, the cellulosic hole trapping material of this invention may incorporated into the charge generating layer, into an overcoating layer or into a blocking layer. For example, where the charge trapping material of this invention is incorporated into the charge generating layer, the photoresponsive device of this invention may have an electrically conductive layer adjacent to the charge generating layer or adjacent to the charge transport layer. In still another embodiment, where the cellulosic hole trapping material of this invention is incorporated into a layer contiguous to the charge generating layer, the photoresponsive device of this invention may have an electrically conductive layer adjacent to the charge transport layer or adjacent to the layer containing the charge trapping material. These photoresponsive devices can be employed in copiers, duplicators and printing systems.

The substrate may be opaque or substantially transparent and may comprise numerous suitable materials having the required mechanical properties. A conductive layer or ground plane which may comprise the entire supporting substrate or be present as a coating on an underlying member (e.g. inorganic materials such as metals or organic materials such as polymeric films) may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotographic imaging member. Accordingly, the conductive layer can generally range in thickness of from about 50 Angstroms to many centimeters. When a flexible photoresponsive imaging device is desired, the thickness may be between about 100 Angstroms to about 5,000 Angstroms. The underlying member may be of any conventional material including metal, organic polymers and the like. Typical underlying members include insulating non-conducting materials comprising various resins known for this purpose including polyesters, polycarbonates, polyamides, polyethylene, polypropylene polyurethanes, and the like. The coated or uncoated supporting substrate may be flexible or rigid and may have any one of many different configurations such as, for example, a plate, a cylindrical drum, a scroll, a film, an endless flexible belt, and the like. Preferably, the insulating substrate is in the form of an endless flexible belt and comprises a commercially available polyethylene terephthalate polyester known as Mylar available from E. I. du Pont de Nemours & Co.

The cellulosic hole trapping materials of this invention can be used alone or admixed with other charge trapping materials and or other materials in a trapping layer or incorporated into the photogenerator layer itself. If the hole trapping materials of this invention are utilized in a layer different from the photogenerator layer, its location relative to the conductive substrate depends upon the polarity of charge applied to the imaging surface of the imaging member of this invention. Thus, the charge trapping layer of this invention may be applied to either an electrically conductive substrate or applied to the outer imaging surface of a photogenerator layer. For imaging systems utilizing negative surface charging, the hole trapping layer of this invention is applied to the conductive substrate. For positive surface charging imaging systems, the cellulosic hole trapping layer of this invention is applied to the outer surface of the photogenerator layer.

If desired, a suitable trapping material other than the cellulosic hole trapping layer of this invention may be utilized in the hole trapping or blocking layer. Thus, if a hole trapping or blocking layer is employed, it may contain the hole trapping material of this invention with or without other materials, or contain materials other than the hole trapping material of this invention. If the the latter embodiment is selected, the hole trapping material of this invention is normally incorporated into the photogenerator layer. However, the hole trapping material of this invention may also be incorporated into both the photogenerator layer and a separate hole trapping layer.

Where the hole trapping material of this invention is employed in a hole trapping layer, satisfactory results may be obtained when the hole trapping layer, forming mixture contains from about 0.01 percent by weight to about 100 percent by weight of the hole trapping material of this invention based on the total solids content of the layer forming mixture. Preferably, the hole trapping layer forming mixture comprises from about 5 percent by weight to about 100 percent by weight of the hole trapping material of this invention based on the total solids content of the layer forming mixture to minimize the formation of white spots deficient of toner material in the image areas of final copies. A prefered blocking material, for use as a supplement to or as the only component in the hole trapping layer, comprises a hydrolyzed silane which forms a reaction product with the metal oxide layer of a conductive anode.

The electrophotographic imaging member may be prepared by depositing on the metal oxide layer of a metallic layer a coating of an aqueous solution of the hydrolyzed silane with or without the hole trapping material of this invention at a pH between about 4 and about 10, drying the reaction product layer to form a siloxane film and applying the generating layer and charge transport layer to the siloxane film.

Typical hydrolyzable silanes include 3-aminopropyl triethoxy silane, (N,N-dimethyl 3-amino) propyl triethoxysilane, N,N-dimethylaminophenyl silane, N-phenyl aminopropyl trimethoxy silane, triethoxy silylpropylethylene diamine, trimethoxy silylpropylethylene diamine, trimethoxy silylpropyldiethylene triamine and mixtures thereof.

During hydrolysis of the amino silanes described above, the alkoxy groups are replaced with hydroxyl groups. After drying, the siloxane reaction product film formed from the hydrolyzed silane contains larger molecules. The reaction product of the hydrolyzed silane may be linear, partially crosslinked, a dimer, a trimer, and the like and may react with the cellulosic hole trapping material of this invention if the cellulosic hole trapping material is incorporated into the hole trapping or blocking layer with the silane.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.01 percent by weight to about 5 percent by weight of the silane based on the total weight of the solution. A solution containing from about 0.05 percent by weight to about 3 percent by weight silane based on the total weight of solution are preferred for stable solutions which form uniform reaction product layers. It is critical that the pH of the solution of hydrolyzed silane be carefully controlled to obtain optimum electrical stability. A solution pH between about 4 and about 10 is preferred. Optimum reaction product layers are achieved with hydrolyzed silane solutions having a pH between about 7 and about 8, because inhibition of cycling-up and cycling-down characteristics of the resulting treated photoreceptor are maximized. Cycling-down may occasionally be tolerable with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, methylcellosolve, ethylcellosolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution, with or without the hole trapping material of this invention, to the metal oxide layer of a metallic conductive anode layer. Typical application techniques include spraying, dip coating, roll coating, wire wound rod coating, and the like. It is preferred that the alcoholic or aqueous solution of hydrolyzed silane and hole trapping material of this invention be prepared and uniformly mixed prior to application to the metal oxide layer. Generally, satisfactory results may be achieved when the hole trapping material of this invention and the reaction product of the hydrolyzed silane and metal oxide layer forms a layer having a thickness between about 20 Angstroms and about 2,000 Angstroms. As the reaction product layer becomes thinner, hole blocking efficiency begins to decrease. As the thickness of the coating layer increases, the injection barrier becomes more non-conducting and residual charge tends to increase because of electron trapping and thicker blocking layer films tend to present a serious problem to the point where increases in residual charges become unacceptable. A thick and brittle coating is, of course, not suitable for flexible photoreceptors, particularly in high speed, high volume copiers, duplicators and printers.

Drying or curing of the fabricated blocking layer should be conducted at a temperature greater than about room temperature to provide a layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer and trapping material utilized and is limited by the temperature sensitivity of the substrate. Reaction product layers having optimum electrochemical stability are obtained when reactions are conducted at temperatures of about 100° C.–135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 60 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures. The hydrolized silane appears to react with the metal hydroxide molecules in the pores of the metal oxide layer as well as with the hydroxyl groups of the cellulosic hole trapping material of this invention. The siloxane coating component is described in U.S. Pat. No. 4,464,450, entitled Multi-layer Photoreceptor Containing Siloxane on a Metal Oxide Layer, the disclosure of this application being incorporated herein in its entirety.

In some cases, intermediate layers between the injection blocking layer and the adjacent charge generating or photogenerating layer may be desired to improve adhesion or to act as an electrical barrier layer. If such layers are utilized, they preferably have a dry thickness between abut 0.1 micron to about 5 microns. Typical adhesive layers include film-forming polymers such as polyester, du Pont 49,000 resin (available from E. I. du Pont de Nemours & Co.), polyvinylbutyral, polyvinylpyrolidone, polyurethane, polymethyl methacrylate and the like.

Any suitable charge generating or photogenerating material may be employed in one of the two or more electrically operative layers in the multilayer photoconductor prepared by the process of this invention. The photogenerating layer includes, for example, numerous photoconductive charge carrier generating materials provided that they are electronically compatible with the charge carrier transport layer, that is, they can inject photoexcited charge carriers into the transport layer and charge carriers can travel in both directions across the interface between the two layers. The light absorbing photogeneration layer may contain organic photoconductive pigments and/or inorganic photoconductive pigments. Typical organic photoconductive pigments include vanadyl phthalocyanine and other phthalocyanine compounds described in copending application U.S. Ser. No. 487,953, filed on Apr. 25, 1983, entitled "Overcoated Photoresponsive Devices", metal-free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, squaraine pigments, such as hydroxyl squarilium pigments, squarylium compounds disclosed in copending application U.S. Ser. No. 613,137, filed on May 23, 1984, entitled "Silylated Compositions and Deuterated Hydroxyl Squaraine Compositions and Processes", pyridinium compounds, azo dyes, diazo dyes, polynuclear aromatic quinones available from Allied Chemical Corporation under the tradename Indofast Double Scarlet, Indofast Violet Lake B, Indofast Brilliant Scarlet and Indofast Orange, thiopyrylium pigments, and the like. Typical inorganic photosensitive pigments include amorphous selenium, trigonal selenium, mixtures of Groups IA and IIA elements, $As_2Se_3$, selenium alloys, cadmium selenide, cadmium sulfo selenide, copper and chlorine doped cadmium sulfide, trigonal selenium doped with sodium carbonate as described in U.S. Pat. Nos. 4,232,102 and 4,233,283, and the like. Other examples of charge generator layers are disclosed in U.S. Pat. No. 4,265,990, U.S. Pat. No. 4,233,384, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein in their entirety.

Any suitable inactive resin binder material may be employed in the charge generator layer. Typical organic resinous binders include polycarbonates, acrylate polymers, vinyl polymers, polyesters, polysiloxanes, polyamides, polyurethanes, epoxides, and the like. Many organic resinous binders are disclosed, for example, in U.S. Pat. No. 3,121,006, and U.S. Pat. No. 4,439,507, the entire disclosures of which are incorporated herein by reference. Organic resinous polymers may be block, random or alternating copolymers.

The photogenerating layer containing photoconductive compositions and/or pigments, and the resinous binder material generally ranges in thickness of from about 0.01 micrometer to about 10 micrometers, and preferably has a thickness of from about 0.2 micrometer to about 3 micrometers. Generally, the maximum thickness of this layer is dependent primarily on factors such as mechanical considerations, while the minimum thickness of this layer is dependent on for example, the pigment particle size, optical density of the photogenerating pigment, and the like. Thicknesses outside these ranges can be selected providing the objectives of the present invention are achieved.

The photogenerating composition or pigment is present in the resinous binder composition in various amounts, generally, however, from about 5 percent by weight to about 80 percent by weight, and preferably in an amount of from about 10 percent by weight to about 50 percent by weight. Accordingly, in this embodiment the resinous binder such as a polyester (e.g. PE-100 and PE-200, available from Goodyear Tire and Rubber Co.) or polycarbonate is present in an amount of from about 95 percent by weight to about 20 percent by weight, and preferably in an amount of from about 90 percent by weight to about 50 percent by weight. The specific proportions selected depends to some extent on the thickness of the generator layer and the amount of cellulosic hole trapping material employed in the photogeneration layer.

For positive (hole) transporting systems, i.e. photoreceptors containing a hole transporting layer, the cellulosic hole trapping material of this invention may comprise polymeric, oligomeric, and monomeric forms containing electron-rich functional groups (or shallow hole trapping material) such as hydroxyl (—OH), ether (—O—), and amine (primary, secondary, and tertiary amines). The cellulosic hole trapping material may be used in the generator layer or in a separate layer on a side of the generator layer opposite the side of the generator layer facing the transport layer. Typical hydroxyl (—OH) containing shallow hole trapping materials include hydroxyethylcellulose, hydroxypropylcellulose, hydroxybutylcellulose, hydroxypentylcellulose, hydroxyhexylcellulose, and the like. Typical ether (—O—) containing shallow hole trapping materials include methylcellulose, ethylcellulose, and the like. Typical amine (primary, secondary, and tertiary amines) containing shallow hole trapping materials include aminoethylcellulose, aminopropylcellulose, other amino derivatives of cellulose, and the like. Polymeric materials are preferred because of their low volatility, film forming ability and good long-term stability. These shallow hole trapping materials are desirable to temporarily hold positive charges either near the photoreceptor surface or on the conductive electrode and prevent premature hole injection thereby improving charge acceptance characteristics and dark decay rate. The optimum amount of materials used in the photoreceptors can be experimentally determined. The preferred cellulosic hole trapping materials of this invention should preferrably be chemically and eletrochemically stable and should not interfere with the normal operation of the imaging process.

Hydroxyalkyl cellulose compounds and its derivatives in this invention contain many chemically reactive hydroxyl groups which are chemically modified and can react with various reactive organic and organometallic componds bearing amino functional groups to yield soluble reaction products. Such products can also be used as hole trapping materials because they contain a Lewis base. For purposes of illustration, the reaction of hydroxypropyl cellulose with methoxy dimethyl gamma-aminopropylsilane with or without a catalyst can produce a cellulosic material containing a dimethyl gramma-aminopropylsily ether group or groups. The extent of the reaction depends on the ratio of the two rectants and the reaction conditions. Another illustrative example is the reaction of hydroxypropyl cellulose with an ester containing amino fuctional groups such as methyl 3-N,N-dimethylaminopropionate in the presence of a catalyst to yield a transesterification product which is a hydroxypropyl cellulose ester of 3-N,N-dimethylaminopropionate. Thus, both hydroxyalkyl cellulose and its reaction products (derivatives) involving a hydroxyl functional group or groups are intended to be included within the the class of cellulosic hole trapping materials of this invention. The following is a structural formula for cellulosic hole trapping materials free of electron withdrawing groups.

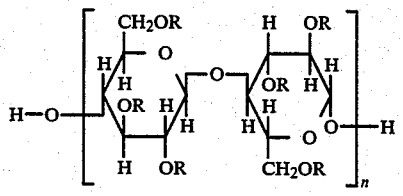

wherein each R is independently selected from the group consisting of hydrogen and a substituted or unsubstituted group selected from the group consisting of an alkyl group containing 1 to 20 carbon atoms, a hydroxyalkyl group containing 1 to 20 carbon atoms, a hydroxyether group containing 1 to 20 carbon atoms and an aminoalkyl group containing 1 to 20 carbon atoms, and n is the number of cellulose repeating units from 1 to 3,000. The cellulosic repeating units as well as its substituents should be free from electron withdrawing groups such as $NO_2$ groups, CN groups, and the like.

The cellulosic hole trapping material of this invention may be added to the photogeneration layer or be applied as a separate layer which is applied to the side of the photogeneration layer opposite the side facing the transport layer, i.e. the side of the photogeneration layer facing away from the transport layer. For example, when the photgenerator layer is sandwiched between a charge transport layer and a conductive layer, the cellulosic charge or hole trapping material can be used as an additive in the photogeneration layer or in a trapping layer sandwiched between the photogeneration layer and the conductive layer. Alternatively, when the charge transport layer is sandwiched between a photogeneration layer and a conductive layer, the cellulosic charge trapping material can be used as an additive in the photogeneration layer or in a layer on the surface of the photogeneration layer which faces away from the charge transport layer. The cellulosic charge trapping material may, for example, be dissolved in a solvent system and directly coated onto a conductive layer. It can also be dissolved in a solvent system and mixed with photoconductive organic pigments such as a metal phthalocyanine, squaraine derivative, thiopyrylium pigment, azo dyes or various inorganic photoconductive pigments such as trigonal selenium and polymeric binders and then coated onto a transport layer containing a resin binder and a diamine compound or a hydrazone compound supported on an electrically conductive layer such as aluminum. When the desired cellulosic charge trapping material is added to known photogeneration layer coating fabrication formulations, the charge trapping material should be soluble in the coating solvent for the photoconductive pigment polymer matrix. It is desirable that the cellulosic charge trapping material be homogeneously dispersed in the charge trapping layer after drying. If the cellulosic charge trapping material is used in the photogeneration layer, it is desirable that the material after drying is located near the surface of the photogenerator layer facing the conductive layer for negative surface charging and near the outer surface of the photogenerator layer facing away from the transport layer if positive surface charging is contemplated. Concentrating the cellulosic hole trapping material along the surface of the photogenerator layer facing away from the transport layer may be achieved by any suitable technique. For example, if desired, a photogenerator layer may be formed on a transport layer and thereafter coated with the cellulosic hole trapping material dissolved in a solvent which is a partial or marginal solvent for the polymeric binder of the photogenerator layer. The partial solvent partially dissolves the outer surface of the photogenerator layer and allows the cellulosic hole trapping material to intermix with the dissolved polymeric binder and penetrate into and deposit near the outer surface of the photogenerator layer. This arrangement is desirable for maximum hole trapping effectiveness for this embodiment with a minimum quantity of cellulosic hole trapping material and to minimize hole trapping at the interface between the photogenerator layer and transport layer. Sufficient cellulosic hole trapping material should be deposited near the surface of the photogenerator layer facing away from the transport layer to maximize charge acceptance and minimize dark decay as compared to a control that does not contain any hole trapping material. Since the amount of hole trapping material to be employed depends upon factors such as the specific cellulosic hole trapping material, layer thicknesses and photogenerator materials employed, it is best determined experimentally.

The cellulosic hole trapping material may be employed either in a monomeric or polymeric form. Satisfactory results may be achieved when the photogeneration layer contains from about 0.01 percent by weight to about 15 percent by weight of the cellulosic hole trapping material based on the total weight of the photogeneration layer. When less than about 0.01 percent by weight is employed, the beneficial effects on improving charge acceptance and reducing dark decay become negligible. When the cellulosic hole trapping material content exceeds about 15 percent by weight of the charge trapping material based on the total weight of the photogeneration layer, the photosensitivity of the photoreceptor decreases significantly. Preferably, the photogeneration layer contains from about 0.1 percent by weight to about 6 percent by weight of the cellulosic hole trapping material based on the total weight of the photogeneration layer and optimum results are achieved with about 0.3 percent by weight to about 3 percent by weight of the charge trapping material based on the weight of the photogeneration layer. Where the photogeneration layer is sandwiched between a charge-transport layer and a conductive layer, polymer solutions containing photoconductive pigments and the cellulosic hole trapping material can be thoroughly mixed and coated on the conductive substrate which may optionally carry an interface layer.

Where the cellulosic hole trapping material of this invention is employed in a separate layer, the cellulosic hole trapping material may comprise the entire separate layer. If desired, the separate layer comprising the cellulosic hole trapping material may also contain up to about 99.99 percent by weight of a different hole blocking or trapping material. Generally, if the cellulosic hole trapping material of this invention is employed only in a separate layer, the cellulosic hole trapping material should be present in the separate layer in an amount of at least 0.01 weight percent in the final dried or cured layer to secure adequate benefits from improved coating uniformity, minimization of pin hole effects and suitable hole trapping. This non-cellulosic hole trapping material may be selected from any suitable material that is soluble in the same solvent employed for the cellulosic hole trapping material. The separate hole trapping layer comprising a hole trapping material is continuous and generally has a thickness of less than about 1 micrometer, and preferably has a thickness of less than about 0.2 micrometer. Thicknesses greater than about 1 micrometer leads to inefficient electron or charge migration. A solution containing the charge trapping material can be coated on a conductive substrate to form a thin layer prior to the deposition of a photogeneration layer. A separate layer containing the cellulosic hole trapping material of this invention is preferred because it can be deposited with greater control over the concentration of the cellulosic hole trapping material per unit area, thereby providing more precise and effective control of high dark decay and poor charge acceptance. Since the effect of the cellulosic hole trapping material depends to some extent on the particular electrophotographic imaging member treated and the specific cellulosic hole trapping material employed, the optimum concentration in the electrophotographic imaging member can be determined experimentally by comparison with a control.

As described above, incorporation of the cellulosic charge trapping materials of this invention to electrophotographic imaging members generally depends upon the configuration of the electrophotographic imaging member. For example, where the electrophotographic imaging member comprises hole transport layers sandwiched between a conductive substrate and a photogenerating layer, the cellulosic hole trapping material of this invention may be utilized in the photogeneration layer or in a coating on the surface of electrophotographic imaging member facing away from the transport layer. Where the electrophotographic imaging member comprises a photogeneration layer sandwiched between a conductive layer and a hole transport layer, the hole trapping material of this invention is employed between the conductive layer and the photogenerating layer. In this latter embodiment, pin hole defects caused by non-uniform coating are minimized because the coatings containing the cellulosic hole trapping material are very uniform on the conductive substrate. After drying, these materials form a continuous film and, in some cases, can be cured to improve adhesion to the metal oxide surface of the conductive substrate. The cured film cannot be easily removed or destroyed by the common nonpolar solvents employed for the coating of the photogeneration layer. Moreover, dark decay rates, long term cyclic stability and charge acceptance are improved. Preferably, the layer containing the cellulose hole trapping material in this latter embodiment has a thickness between about 10 Angstroms and about 1,000 Angstroms.

A photoreceptor device was prepared to illustrate the use of a separate hole trapping layer containing the cellulosic hole trapping material of this invention. A number of polyester substrates (Mylar, available from E. I. du Pont de Nemours & Co.) coated with titanium and having a thickness of 3 mils were coated, using a Bird applicator, with various different solutions containing different concentrations of a cellulosic hole trapping material of this invention, hydroxypropylcellulose. Some of the solutions also contained different concentrations of gamma-aminopropyltriethoxylsilane. The specific concentrations, electrical characteristics and thicknesses of the electrophotographic imaging member prepared are set forth in Tables A and B below. The hole trapping layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer had a dry thickness of about 2 microns. The photogenerator layer was overcoated with a charge transport layer. The charge transport layer containing N,N'-diphenyl-N,N'-bis(3-methylphenyl)-1,1'-biphenyl-4,4'-diamine and Makrolon®, a polycarbonate resin having a molecular weight of from about 50,000 to 100,000 (available from Larbensabricken Bayer A.G.) in a weight ratio of 1:1. This charge transport layer was applied from solution on the photogenerator layer using a Bird applicator to form a uniform coating which upon drying had a thickness of about 25 microns. The resulting photoreceptor device containing all of the above layers was annealed at about 135° C. in a forced air oven for 6 minutes. Substanially the same procedures described were used to prepare all the photoreceptors described in the tables below. Ethanol-solutions of the hydroxycellulose were used in three different concentrations to prepare the hole trapping layer. As indicated in the table below, the weight concentration gradient is reflected in the thickness of the resulting film. For purposes of comparison, three different ratios of gamma-aminopropyltriethoxylsilane (APS) and polyhydroxypropylcellulose (HPC) were also prepared and tested.

TABLE A

| Type | Conc. | $V_o$ | $V_{ddp}$ | $V_{dd}$ | $V_{bg}$ | $V_r$ | Approx. Thickness (A) |
|---|---|---|---|---|---|---|---|
| HPC-G | 0.5% | 1056 | 801 | 225 | 284 | 72 | 720 |
| HPC-G | 0.3% | 1024 | 775 | 249 | 263 | 69 | 581 |
| HPC-G | 0.1% | 1048 | 793 | 255 | 289 | 61 | 161 |
| HPC-H | 0.5% | 1021 | 769 | 252 | 285 | 64 | 776 |
| HPC-H | 0.3% | 1058 | 775 | 283 | 250 | 56 | 529 |
| HPC-H | 0.1% | 1004 | 708 | 296 | 198 | 40 | 198 |

TABLE B

| Type Conc. Ratio | $V_o$ | $V_{ddp}$ | $V_{dd}$ | $V_{bg}$ | $V_r$ | Approx. Thickness (A) |
|---|---|---|---|---|---|---|
| APS/HPC-G 20/1 | 1177 | 774 | 403 | 173 | 34 | — |
| APS/HPC-G 3/1 | 1177 | 777 | 400 | 180 | 33 | — |
| APS/HPC-G 1/1 | 1159 | 816 | 343 | 210 | 34 | — |
| APS/HPC-H 20/1 | 1200 | 799 | 401 | 174 | 36 | — |
| APS/HPC-H 3/1 | 1148 | 785 | 363 | 180 | 31 | — |
| APS/HPC-H 1/1 | 1160 | 811 | 349 | 194 | 34 | — |

All electrical values are expressed in volts. $V_o$ is the initial charge acceptance. $V_{ddp}$ is the dark development potential at probe 4 at 90 cycles, $V_{dd}$ is the dark decay voltage at 90 cycles. $V_{bg}$ is the background potential at 90 cycles and $V_r$ is the residual potential at 90 cycles. The letter G represents hydroxypropylcellulose having a weight average molecular weight of about 275,000 and the letter H represents hydroxypropylcellulose having a weight average molecular weight of about 900,000. The electrical data were all generated on a 30 inch per second scanner under nominal conditions. The mixed system trapping layer thickness were not measured in Table B, but are believed to be about 300 Angstroms thick. Although the trapping layers in the above Tables have not been optimized, they clearly demonstrate for purposes of demonstration only that the dark decay values for photoreceptors containing hydroxypropylcellulose or combinations of hydroxypropylcellulose and gamma-aminopropyltriethoxysilane decrease as the concentration or the thickness of the trapping layer thickness increases.

The charge trapping material also should not adversely affect the desired electrical and physical properties of the electrophotographic imaging member. Thus, such charge trapping material should not themselves significantly alter the nominal functions of the photogeneration layer material or of any of the other layers present in the electrophotographic imaging member. Additionally, when selecting the charge trapping materials of this invention, it is important that these materials do not introduce undesired conducting states in any layer as a result of any unfavorable chemical reactions. Additionally, the charge trapping material of the present invention should be selected so as to be compatible with other components in the electrophotographic imaging member.

Any suitable solution coating techniques may be used to fabricate the photogeneration layer or separate charge trapping layer which contains the charge trapping material of this invention provided that they do not adversly affect the performance of the photoreceptor.

The charge trapping material of this invention may be employed in a separate layer or in the photogeneration layer to improve the electrical properties of a photoreceptor such as charge acceptance, dark decay rate, photosensitivity, electrical stability and the like. Photoreceptors containing a charge transport layer sandwiched between a conductive layer and a photogeneration layer comprising vanadyl phthalocyanine can exhibit unstable charge acceptance in the first few imaging cycles and high dark decay. The use of the cellulosic hole trapping material of this invention minimizes this problem thereby improving the stability of photoreceptors.

The charge trapping of this invention may be employed in an electrophotographic imaging member which utilizes organic hole transport layers. Typical organic hole transport layers utilize various aromatic amine compounds, hydrazone derivatives and the like. These hole transport materials have low ionization potentials and allow holes to move easily through the charge transport layer. These hole transport materials can also be easily oxidized or photooxidized to produce undesired cationic species which can conduct or inject into the photoreceptor and cause high dark decay and poor charge acceptance. The use of the cellulosic hole trapping materials of this invention can minimize the undesired injection problem.

The preferred transport layer employed in one of the two electrically operative layers in the multilayered or composite photoconductor prepared by the process of this invention comprises about 25 to about 75 percent by weight of at least one charge transporting aromatic amine compound or hydrazone compound, about 75 to about 25 percent by weight of an polymeric film forming resin in which the aromatic amine is dispersible, and about 1 to about 10,000 parts per million based on the weight of the aromatic amine of protonic acid or Lewis acid soluble in a suitable solvent such as methylene chloride. The charge transport layer generally has a thickness in the range of from about 5 to about 50 micrometers, and preferably a thickness of from about 10 to about 40 micrometers.

The aromatic amine compound may be of one or more compounds having the general formula:

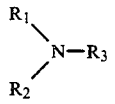

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms or a hydrazone molecule having the general formula:

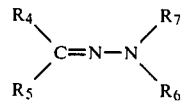

wherein $R_4$, $R_5$, $R_6$ and $R_7$ are selected from the group consisting of hydrogen, substituted or unsubstituted phenyl group, naphthyl group, carbazoyl group, biphenyl group, diphenyl ether group, alkyl group having 1 to 18 carbon atoms, and cycloaliphatic group having 1 to 18 carbon atoms.

A preferred aromatic amine compound has the general formula:

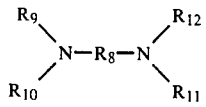

wherein $R_8$ is selected from the group consisting of a substituted or unsubstituted phenyl group, biphenyl group, diphenyl ether group, alkyl group having from 1 to 18 carbon atoms, and cycloaliphatic group having from 3 to 12 carbon atoms and $R_9$, $R_{10}$, $R_{11}$ and $R_{12}$ are an aromatic group selected from the group consisting of substituted or unsubstituted phenyl group, naphthyl group and polyphenyl group. The substituents should be free from electron withdrawing groups such as $NO_2$ groups, CN groups, and the like. Generally these aromatic amines have an ionization potential of below about 7.7 e.v.

Examples of charge transporting aromatic amines represented by the structural formula above for charge transport layers capable of supporting the injection of photogenerated holes of a charge generating layer and transporting the holes through the charge transport layer include triphenylmethane, bis(4-diethylamine-2-methylphenyl)phenylmethane; 4′-4″-bis(diethylamino)-2′,2″-dimethyltriphenyl-methane, N,N′-bis(alkylphenyl)-[1,1′-biphenyl]-4,4′-diamine wherein the alkyl is, for example, methyl, ethyl, propyl, t-butyl, n-butyl, etc., N,N′-diphenyl-N,N′-bis(chlorophenyl)-[1,1′-biphenyl]-4,4′-diamine, N,N′-diphenyl-N,N′-bis(3″-methylphenyl)-(1,1′-biphenyl)-4,4′-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polymethacrylate, polyacrylate, polyether, polystyrene, polysulfone, and the like. Molecular weights can vary from about 10,000 to about 1,500,000.

Any suitable and conventional technique may be utilized to mix and thereafter apply the charge transport layer coating mixture to the imaging member. Typical application techniques include spray coating, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 to about 100 microns, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to about 200:1 and in some instances as great as 400:1.

In some cases, intermediate layers between the blocking layer or conductive layer and the adjacent photogeneration layer or hole transport may be desired to improve adhesion or to act as an electrical barrier layer. If such layers are utilized, the layers preferably have a dry thickness between about 0.1 micron to about 5 microns. Typical adhesive layers include film-forming polymers such as polyester, du Pont 49,000 resin, PE-100 (available from Goodyear Tire and Rubber Co.), polycarbonate, polyvinylbutyral, polyvinylpyrolidone, polyurethane, polymethyl methacrylate and the like. The cellulosic hole trapping material of this invention may also be added to the adhesive layer if desired.

Optionally, an overcoating layer may also be utilized to improve resistance to abrasion, oxidation or photodegradation. These overcoating layers may comprise organic polymers, inorganic polymers or inorganic metals such as selenium alloys that are electrically insulating or slightly semi-conductive. If desired, the cellulosic hole trapping material of this invention may also be applied to either side of the overcoating layer depending upon the conductive nature of the overcoating layer.

The photogenerating layers prepared in accordance with the process of the present invention are useful in various photoconductive devices. In one embodiment, there can be prepared a layered photoresponsive device comprising a supporting substrate, a hole trapping material layer prepared in accordance with the present invention, photogenerating layer, and a charge transport layer with or without an overcoating layer. In another embodiment, the photoresponsive device comprises a substrate, a charge transport layer and a charge generating layer with or without a separate hole trapping layer prepared in accordance with the present invention. In still another embodiment, photoresponsive devices useful in imaging systems may comprise a photogenerating layer containing the cellulosic hole trapping material of the present invention sandwiched between a charge transport layer and a conductive substrate or a photogenerating layer containing the cellulosic hole trapping material of the present invention positioned between a transport layer and an overcoating protective layer or a photogenerating layer containing the cellulosic hole trapping material of the present invention positioned on the imaging surface of the photoconductive device.

Photoreceptors containing the cellulosic hole trapping materials of this invention exhibit improved photoreceptor electrical properties such as charge acceptance, dark decay rate, cyclic stability, and the like. It is believed that these cellulosic hole trapping materials can prevent undesirable charge injection prior to photodischarge. The dark decay rate of a photoreceptor comprising a charge transport layer sandwiched between a conductive layer and a photogeneration layer can also be reduced with the celluosic hole trapping materials of this invention. Most of the undesired hole injection from either the conductive substrate or the outer imaging surface of the photoreceptor can be minimized or significantly retarded.

A number of examples are set forth herein below and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A sheet of aluminized mylar was overcoated with a 20 micrometer charge transport layer containing 40 percent by weight of N,N'-diphenyl-N,N'-bis(3-methylphenyl)-1,1'-biphenyl-4,4'-diamine dispersed in 60 percent by weight the polycarbonate resinous binder Makrolon. A dispersion of photoconductive pigment was prepared by adding 0.128 grams of vanadyl phthalocyanine and 50 grams of 0.125 inch no. 302 stainless steel shot to a solution of 0.380 grams of Goodyear Vitel polyester resin in 8.0 ml of dichloromethane in a 2 oz. amber bottle followed by shaking in a paint-shaker. The dispersion was coated onto the charge transport layer with a 1.0 mil gap Bird-type applicator bar. The device was air-dried followed by drying under vacuum at 100° C. for 2.5 hours.

EXAMPLE II

A photoresponsive device was prepared by repeating the process of Example I with the exception that 0.371 ml of a 10.2 mg/ml solution of Scientific Polymer Products hydroxypropyl cellulose (HPC) in dichloromethane was added to the paint-shaken dispersion and shaken on a wrist-action shaker for 15 minutes before coating.

EXAMPLE III

A photoresponsive device was prepared by repeating the process of Example II with the exception that 0.748 ml of the hydroxypropylcellulose solution was added.

EXAMPLE IV

A photoresponsive device was prepared by repeating the process of Example I with the exception that the finished device was overcoated with a solution consisting of 5.0 mg/ml hydroxypropylcellulose in water. The device was then dried under vacuum at 50° C. for 1 hour.

EXAMPLE V

A photoresponsive device was prepared by repeating the process of Example I with the exception that there was chosen as a replacement for the vanadyl phthalocyanine 0.128 grams of bis(4-N,N-dimethylamino-2-hydroxyphenyl)-squaraine (OHSq).

EXAMPLE VI

A photoresponsive device was prepared by repeating the process of Example V with the exception that the finished device was overcoated with a solution consisting of 5 mg/ml hydroxyproylcellulose in a 20 volume percent solution of acetone in water. The device was then dried under vacuum at 50° C. for 1.5 hours.

EXAMPLE VII

A photoresponsive device was prepared by repeating the process of Example V with the exception that there was chosen as a replacement for the PE100, 0.380 grams of the polycarbonate resin Makrolon.

EXAMPLE VIII

A photoresponsive device was prepared by repeating the process of Example V with the exception that there was added to the polymer solution before shaking 1.0 ml of a solution consisting of 3.81 mg/ml hydroxypropyl cellulose in dichloromethane.

EXAMPLE IX

A photoresponsive device was prepared by repeating the process of Example I with the exceptions that PE100 was replaced with 0.210 g of Polyscience polystyrene and the vanadyl phthalocyanine was replaced with 0.0903 grams of bis(2-hydroxy-4-N,N-dimethylamino-6-methyl phenyl)squaraine.

EXAMPLE X

A photoresponsive device was prepared by repeating the process of Example IX except that the finished device was overcoated with a solution consisting of 5 mg/ml hydroxypropyl cellulose in a 20 volume percent solution of acetone in water. The coating was accomplished using a 4 mil gap Bird-type applicator bar and the device was air-dried and dried under vacuum at 50° C. for 1.5 hours.

EXAMPLE XI

Several of the above prepared photoresponsive devices were then electrically tested by charging them with a constant voltage corotron and photodischarging the devices with a specific wavelength of light (for example, 597 nm or 800 nm). The charging and photodischarging processes were monitored by an electrometer and recorded on a strip recorder. The results of electrical testing of the devices prepared in Examples I through X are compared in the Table C below:

TABLE C

| Device Preparation Information | Corotron Voltage (KV) | Charge Level (V) | Dark Decay (V/sec) | Residual Voltage (V) | 597 nm Maximum Sensitivity ($Vcm^2/erg$) | 597 nm Energy to ½ Vddp ($erg/cm^2$) | 800 nm Maximum Sensitivity ($Vcm^2/erg$) | 800 nm Energy to ½ Vddp ($erg/cm^2$) |
|---|---|---|---|---|---|---|---|---|
| 25% VOPC in PE100 | 6.80 | 9.67 | 160 | 18 | 90.8 | 6.78 | 86.1 | 8.67 |
| 25% VOPC in PE100 - 1% HPC in binder | 5.50 | 952 | 38 | 10 | 103.0 | 8.41 | 113.0 | 7.47 |

The surface potential (charge level) of the above prepared photoresponsive device just prior to the light exposure is represented by $V_{ddp}$. The maximum sensitivity was calculated as the maximum photodischarge rate divided by the radiant power of the light, and the energy to ½ $V_{ddp}$ was the light energy required to discharge the device to ½ of its original surface potential value. Dark decay is the maximum rate of discharge from $V_{ddp}$ without light exposure and residual voltage is the surface charge level after 0.5 second of white-light erase exposure.

EXAMPLE XII

An aluminum alloy drum was spray-coated with a solution consisting of 40 weight percent N,N'-diphenyl-N,N'-bis(3methyl phenyl)-1,1'-biphenyl-4,4'-diamine in polycarbonate resin Makrolon dissolved in a 1:1.4 volume ratio of 1,2-dichloroethane:dichloromethane and dried to form a 15 micrometer coating. A dispersion of photoconductive pigment was prepared by adding 19.3 grams of vanadyl phthalocyanine to a solution of 100 grams of Goodyear Vitel PE100 polyester resin dissolved in 390 ml of 1,2-dichloroethane and 550 ml of dichloromethane and roll-milling. 100 ml of this dispersion was diluted with 300 ml of a 1:1.4 volume ratio of solution of dichloromethane and 1,2-dichloroethane which contained 0.090 gram of Sigma Chemical Company d,l-a-tocopherol. This diluted mixture was roll-milled and then spray-coated onto the charge-transport layer coated drum to give a 1.0 micrometer thick coating. The completed drum was then overcoated with a 1.5 micrometer thick coat of 2% by weight As in Se alloy by vacuum deposition.

EXAMPLE XIII

A photoresponsive device was prepared by repeating the process of Example XII with the exception that the diluent solution also contained 0.045 grams of Scientific Polymer Products hydroxypropyl cellulose.

EXAMPLE XIV

A photoresponsive device was prepared by repeating the process of Example XII except that the diluent solution also contained 0.090 gram of hydroxypropyl cellulose.

EXAMPLE XV

Photoreceptor devices described in Examples XII--XIV were mounted on a cylindrical metal drum were placed in a test fixture for cyclic testing. The test fixture consisted on a light-tight, temperature and humidity controlled chamber. The drum was mounted on a motor-driven, rotatable shaft. Rotation of the drum caused the devices to pass sequentially under a constant current charge corotron, a wavelength controlled exposure lamp and a white-light erase lamp. Surface potential measurement probes were positioned along the periphery of the drum to determine surface charge on the sample device before and after the corotron, exposure lamp, and erase lamp. The electrical results are shown in Table D.

TABLE D

| Sample No. | Drum No. | Electrical Results of Spray Coated Photoreceptors t | $V_o$ | $E_o$ | $\Delta V_o$ | $S_{825}$ | $V_{R825}$ | CIRCA | % HPC | % 2-T |
|---|---|---|---|---|---|---|---|---|---|---|
| XI | 1323 | 21.9 | 934 | 42.6 | 43 | 63 | 57 | 50 | 0 | 2 |
| XXII | 1328 | 20.8 | 944 | 45.4 | 37 | 58 | 55 | 27 | 1 | 2 |

TABLE D-continued

| Sample No. | Drum No. | Electrical Results of Spray Coated Photoreceptors | | | | | | | | |
|---|---|---|---|---|---|---|---|---|---|---|
| | | t | $V_o$ | $E_o$ | $\Delta V_o$ | $S_{825}$ | $V_{R825}$ | CIRCA | % HPC | % 2-T |
| XXIII | 1279 | 20.2 | 888 | 43.9 | 36 | 48 | 51 | 10 | 2 | 2 |

t = thickness in micrometers for the photoreceptors excluding the thickness of the conductive substrate
$V_o$ = initial surface potential in voltage
$E_o$ = field strength v/micrometer
$\Delta V_o$ = dark decay rate v/sec
$S_{825}$ = sensitivity of the P/R in v-cm$^2$/erg using an 825 nm light source
$V_{R825}$ = residual voltage in volts after the exposure
CIRCA = $V_{18,000}$-$V_{18,001}$ - surface potential difference in volts
HPC = hydroxypropyl celulose
a-T = alpha-tocopherol The data in Table D clearly demonstrates that the addition of hydroxpropyl cellulose significantly reduced CIRCA (27 volts and 10 volts vs. 50 volts) and dark decay (37 volts/sec and 36 volts/sec vs. 43 volts/sec) compared to the control with no hydroxpropyl cellulose.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a hole transport layer comprising an aromatic amine or hydrazone hole transport molecule in a continuous polymeric binder phase, a contiguous charge generation layer, and a cellulosic hole trapping material located in said charge generation layer or in a separate continuous layer having a thickness less than about 1 micrometer on the side of said charge generation layer opposite said hole transport layer, said charge generation layer comprising from about 0.01 percent by weight to about 15 percent by weight of said cellulosic hole trapping material based on the total weight of said charge generation layer, said separate layer comprising from about 0.01 percent by weight to about 100 percent by weight of said cellulosic hole trapping material based on the total weight of said separate layer, and said cellulosic hole trapping material being free of electron withdrawing groups and having the formula

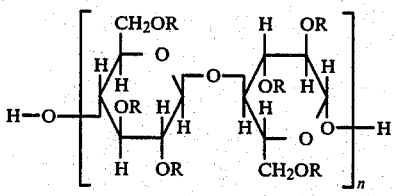

wherein each R is independently selected from the group consisting of hydrogen and a substituted or unsubstituted group selected from the group consisting of an alkyl group containing 1 to 20 carbon atoms, a hydroxyalkyl group containing 1 to 20 carbon atoms, a hydroxyether group containing 1 to 20 carbon atoms and an aminoalkyl group containing 1 to 20 carbon atoms, and n is the number of cellulose repeating units from 1 to 3,000.

2. An electrophotographic imaging member in accordance with claim 1 wherein said cellulosic hole trapping material is a compound selected from the group consisting of a hydroxyalkylcellulose compound and derivatives thereof having a degree of substitution of up to 3 molar substitutions of the hydroxyl group of the cellulose per monosaccharide unit and having a weight average molecular weight between about 700 and about 2,000,000.

3. An electrophotographic imaging member in accordance with claim 2 wherein said hydroxyalkylcellulose compound is hydroxypropylcellulose.

4. An electrophotographic imaging member in accordance with claim 2 wherein said hydroxyalkylcellulose compound is hydroxyethylcellulose.

5. An electrophotographic imaging member in accordance with claim 1 wherein said charge generation layer is sandwiched between said charge transport layer and a layer comprising said cellulosic hole trapping material.

6. An electrophotographic imaging member in accordance with claim 5 wherein said layer comprising said cellulosic hole trapping material is sandwiched between said charge generation layer and an electrically conductive layer.

7. An electrophotographic imaging member in accordance with claim 6 wherein said layer comprising said cellulosic hole trapping material also comprises another hole trapping material.

8. An electrophotographic imaging member in accordance with claim 6 wherein an adhesive layer is sandwiched between said charge generation layer and said layer comprising said cellulosic hole trapping material.

9. An electrophotographic imaging member in accordance with claim 1 wherein said hole transport layer is sandwiched between said charge generation layer and an electrically conductive layer.

10. An electrophotographic imaging member in accordance with claim 1 wherein said aromatic amine compound has the general formula:

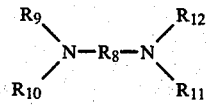

wherein $R_8$ is selected from the group consisting of a substituted or unsubstituted phenyl group, biphenyl group, diphenyl ether group, alkyl group having from 1 to 18 carbon atoms, and cycloaliphatic group having from 3 to 12 carbon atoms and $R_9$, $R_{10}$, $R_{11}$ and $R_{12}$ are an aromatic group selected from the group consisting of substituted or unsubstituted phenyl group, napthyl group and polyphenyl group.

11. An electrophotographic imaging member comprising a hole transport layer comprising an aromatic amine or hydrazone charge transport molecule in a continuous polymeric binder phase and a contiguous charge generation layer comprising a photoconductive charge generating material and from about 0.01 percent by weight to about 15 percent by weight of a cellulosic hole trapping material based on the total weight of said charge generation layer, said cellulosic hole trapping material being free of electron withdrawing groups and having the formula

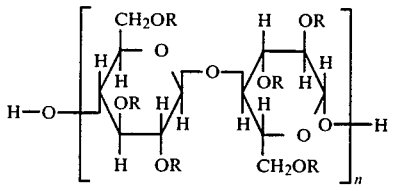

wherein each R is independently selected from the group consisting of hydrogen and a substituted or unsubstituted group selected from the group consisting of an alkyl group containing 1 to 20 carbon atoms, a hydroxyalkyl group containing 1 to 20 carbon atoms, a hydroxyether group containing 1 to 20 carbon atoms and an aminoalkyl group containing 1 to 20 carbon atoms, and n is the number of cellulose repeating units from 1 to 3,000.

12. An electrophotographic imaging member in accordance with claim 11 wherein said charge generation layer is sandwiched between said hole transport layer and an electrically conductive layer.

13. An electrophotographic imaging member in accordance with claim 11 wherein said hole transport layer is sandwiched between said charge generation layer and an electrically conductive layer.

14. An electrophotographic imaging member comprising a hole transport layer comprising an aromatic amine or hydrazone hole transport molecule in a continuous polymeric binder phase, a contiguous charge generation layer, and a separate continuous layer having a thickness less than about 1 micrometer on the side of said charge generation layer opposite said hole transport layer, said separate layer being free of electron withdrawing groups and consisting of cellulosic hole trapping material having the formula

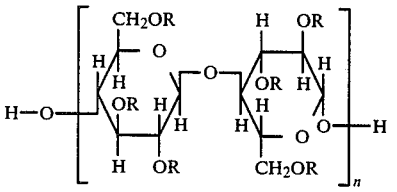

wherein each R is independently selected from the group consisting of hydrogen and a substituted or unsubstituted group selected from the group consisting of an alkyl group containing 1 to 20 carbon atoms, a hydroxyalkyl group containing 1 to 20 carbon atoms, a hydroxyether group containing 1 to 20 carbon atoms and an aminoalkyl group containing 1 to 20 carbon atoms, and n is the number of cellulose repeating units from 1 to 3,000.

15. An electrophotographic imaging member in accordance with claim 14 wherein said hole transport layer is sandwiched between said charge generation layer and an electrically conductive layer.

16. An electrophotographic imaging process comprising providing an electrophotographic imaging member comprising a hole transport layer comprising an aromatic amine or hydrazone hole transport molecule in a continuous polymeric binder phase, a contiguous charge generation layer, and a cellulosic hole trapping material located in said charge generation layer or in a separate continuous layer having a thickness less than about 1 micrometer on the side of said charge generation layer opposite said hole transport layer, said charge generation layer comprising from about 0.01 percent by weight to about 15 percent by weight of said cellulosic hole trapping material based on the total weight of said charge generation layer, said separate layer comprising from about 0.01 percent by weight to about 100 percent by weight of said cellulosic hole trapping material based on the total weight of said separate layer, and said cellulosic hole trapping material being free of electron withdrawing groups and having the formula

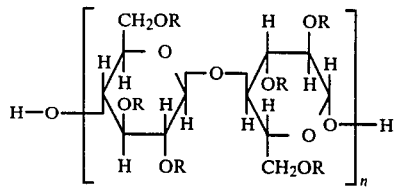

wherein each R is independently selected from the group consisting of hydrogen and a substituted or unsubstituted group selected from the group consisting of an alkyl group containing 1 to 20 carbon atoms, a hydroxyalkyl group containing 1 to 20 carbon atoms, a hydroxyether group containing 1 to 20 carbon atoms and an aminoalkyl group containing 1 to 20 carbon atoms, and n is the number of cellulose repeating units from 1 to 3,000, uniformly depositing an electrostatic charge on said imaging member, exposing said imaging member to activating radiation in image configuration to form an electrostatic latent image on said imaging member, contacting said electrostatic latent image with electrostatically attractable toner particles to form a deposited toner image in image configuration, transfering said toner image to a receiving member, erasing any residual electrostatic charge on said imaging member and repeating said depositing, exposing, contacting, transfering and erasing steps.

* * * * *